US009475206B2

(12) United States Patent
Huang

(10) Patent No.: US 9,475,206 B2
(45) Date of Patent: Oct. 25, 2016

(54) CRAFT PUNCH WITH REPLACEABLE CUTTING TOOL

(75) Inventor: Lijuan Huang, Dongguan (CN)

(73) Assignee: Yingyuan Zhang, Dongguan (CN)

( * ) Notice: Subject to any disclaimer, the term of this patent is extended or adjusted under 35 U.S.C. 154(b) by 229 days.

(21) Appl. No.: 14/364,678

(22) PCT Filed: Dec. 16, 2011

(86) PCT No.: PCT/CN2011/002111

§ 371 (c)(1),
(2), (4) Date: Jun. 12, 2014

(87) PCT Pub. No.: WO2013/086660

PCT Pub. Date: Jun. 20, 2013

(65) Prior Publication Data

US 2014/0338203 A1 Nov. 20, 2014

(30) Foreign Application Priority Data

Dec. 15, 2011 (CN) ..... 2011 1 0419038

(51) Int. Cl.
*B26F 1/14* (2006.01)
*B26F 1/02* (2006.01)
*B26F 1/36* (2006.01)
(Continued)

(52) U.S. Cl.
CPC . *B26F 1/14* (2013.01); *B26F 1/02* (2013.01); *B26F 1/36* (2013.01); *B26D 2007/2607* (2013.01); *B26F 1/32* (2013.01)

(58) Field of Classification Search
CPC ..... B26F 1/14; B26F 1/02; Y10T 83/9423; Y10T 83/943; Y10T 83/9425; Y10T 83/9428; Y10T 83/944; B21D 28/34; B21D 28/26; B21D 28/265; B26D 2007/2607
See application file for complete search history.

(56) References Cited

U.S. PATENT DOCUMENTS 2,857,157 A * 10/1958 Bonquet ..... B30B 15/0064 100/259
3,260,192 A * 7/1966 Ostenberg ..... B41K 3/36 101/28

(Continued)

FOREIGN PATENT DOCUMENTS

CH 479383 A * 10/1969 ..... B21D 28/26
CN 2511454 Y 9/2002

(Continued)

OTHER PUBLICATIONS

English Translation of CN 201743114.*

(Continued)

*Primary Examiner* — Jennifer Swinney

(57) ABSTRACT

A craft punch with a replaceable cutting tool includes a main body having an upper part and a lower part which are spaced up and down. The upper part has a passage, and the lower part has a receiving part to movably receive a lower cutting mold holder. An upper cutting mold holder receiving component could be installed in the passage movably up and down, the upper side of the receiving component bulges to form a tubular part, and one side of the receiving component back to the tubular part is provided with a receiving part which could movably receive an upper cutting mold; a cover plate covers the upper end of the passage and is provided with a through hole allowing the tubular part to pass through an upper bulge, and an upper cover covers the upper side of the cover plate, and is connected with the tubular part.

6 Claims, 4 Drawing Sheets

(51) Int. Cl.
*B26D 7/26* (2006.01)
*B26F 1/32* (2006.01)

(56) References Cited

U.S. PATENT DOCUMENTS 3,299,761 A * 1/1967 Goldman ..... B26F 1/02 234/107
3,463,042 A * 8/1969 Goldman ..... B21D 28/002 83/627
4,123,956 A * 11/1978 Harvey ..... B26F 1/02 83/620
5,601,006 A * 2/1997 Quinn ..... B23D 35/008 83/588
5,647,278 A * 7/1997 Wu ..... B41K 1/003 101/368
6,000,139 A * 12/1999 Chan ..... B26D 5/10 30/278
6,089,137 A * 7/2000 Lee ..... B26F 1/04 30/358
6,189,220 B1 * 2/2001 Chen ..... B26D 5/10 30/358
2007/0062358 A1 * 3/2007 Lam ..... B26D 5/16 83/651
2008/0295666 A1 * 12/2008 Bae ..... B26F 1/14 83/687
2009/0235801 A1 * 9/2009 Chan ..... B26D 7/00 83/686
2010/0206152 A1 * 8/2010 Oh ..... B26D 3/10 83/687

FOREIGN PATENT DOCUMENTS

CN 2709128 Y 7/2005
CN 201565996 U 9/2010
CN 201743114 U * 2/2011
CN 201998222 U 10/2011
DE 1188266 B * 3/1965 ..... B21D 28/26
GB 919396 A * 2/1963 ..... B26F 1/04

OTHER PUBLICATIONS

International Search Report of PCT Patent Application No. PCT/CN2011/002111.
1st office action of counterpart Chinese Patent Application No. 201110419038.9 issued on Sep. 27, 2012.

* cited by examiner

CRAFT PUNCH WITH REPLACEABLE CUTTING TOOL

TECHNICAL FIELD

The present invention relates to the technical field of handicrafts, and in particular relates to a tool for the production of handicrafts.

BACKGROUND

Craft punch is a tool for the production of handicrafts, which is widely used at present. A traditional craft punch consists of two major parts which are part 1, a lower cutting mold: its production process is as follows: a complete lower cutting mold holder with (negative) cutting shape is produced, wherein the cutting shape penetrates through from the top till the bottom in a hollow form, and then a part on the lower cutting mold holder is horizontally sawn to form a gap. As it is not sawn off completely, the lower cutting mold is still integrated, only the part in the (negative) cutting shape on the lower cutting mold holder is divided into upper and lower parts, and the gap is to allow paper to be inserted; and part 2 is an upper cutting mold which is mainly used for cutting and has a cutting shape the same as that of the lower cutting mold, the upper cutting mold has a positive cutting shape, while the lower cutting mold has a negative cutting shape. The positive cutting shape of the upper cutting mold is placed into the upper part of the lower cutting mold with the negative cutting shape, and the upper cutting mold is pressed hard to the bottom of the lower cutting mold holder so as to cut the shape the same as that of the upper cutting mold and the lower cutting mold on the paper which is inserted into the gap. The part in the (negative) cutting shape on the lower cutting mold holder is horizontally sawn to form a gap, this production method is to make sure that the (positive) cutting shape of the upper cutting mold extends from the upper part of the lower cutting mold holder to the bottom absolutely perpendicularly so as to successfully cut the shape the same as that of the upper cutting mold holder and the lower cutting mold holder on the paper in between. Afterwards, a complete craft punch product could be formed by the upper cutting mold and the lower cutting mold through plastic boxes, accessories and springs used for positioning the upper cutting mold on the upper half part of the lower cutting mold holder as well as other assemblies. Under such a mode of production, a lot of raw materials need to be used to produce a lower cutting mold holder part which is relatively hard enough to bear the force of impact from the upper cutting mold, and a single upper cutting mold holder and a single lower cutting mold holder need to be produced for cutting each shape, so that it is a resource-wasting production method; in addition, as the upper cutting mold needs to extend from the upper part of the lower cutting mold holder to the bottom, the upper cutting mold with enough length needs to be produced, and it is also a kind of waste of resources; in addition, the craft punch product with each single shape could be formed by plastic caps, parts, springs and multiple procedures, which also causes another kind of waste; finally, the traditional craft punch produced in this way is inflexible, and only could be used for cutting on a piece of paper in one direction.

In view of the defects and inconvenience of the known craft punch, adhering to the spirit of innovative research to strive for perfection, the applicant develops a craft punch with a replaceable cutting tool which conforms to industrial application with his professional vision and expertise.

SUMMARY OF THE INVENTION

The present invention aims at overcoming the defects of the prior art, and providing a craft punch which is simple in structure, scientific and reasonable, could facilitate the replacement of a lower cutting mold and an upper cutting mold, works more effectively and saves resources.

To achieve the above purpose, the present invention adopts the following technical scheme:

A craft punch with a replaceable cutting tool, comprising:

a main body, having an upper part and a lower part which are spaced up and down, wherein a gap allowing paper to be inserted is formed between the upper part and the lower part, the upper part has a passage, and the lower part has a receiving part to movably receive a lower cutting mold holder;

an upper cutting mold holder receiving component, which could be installed in the passage on the upper part of the main body movably up and down, wherein the upper side of the upper cutting mold holder receiving component is provided with a tubular part, and the side opposite to the upper side of the upper cutter mold holder receiving component with the tubular part is provided with a receiving part which movably receives an upper cutting mold;

a cover plate, which covers the upper end of the passage on the upper part of the main body, and is provided with a through hole allowing the tubular part of the upper cutting mold holder receiving component to pass through;

an upper cover, which covers the upper side of the cover plate, and is connected with the tubular part of the upper cutting mold holder receiving component.

In the above scheme, the receiving part of the upper cutting mold holder receiving component is provided with a slot allowing the upper cutting mold to be movably inserted, and a positioning structure for positioning the of the upper cutting mold, wherein the positioning structure for positioning the insertion of the upper cutting mold comprises a positioning ball and a small spring which are sequentially installed in a hollow part of the tubular part of the upper cutting mold holder receiving component, the upper cover is provided with a convex column which is inserted into an inlet of the tubular part of the upper cutting mold holder receiving component to eject and press the small spring, the other end of the small spring pushes and ejects the positioning ball to enable the positioning ball to be partially exposed out of an opening in the receiving part of the upper cutting mold holder receiving component, and a part of the positioning ball which is exposed out of the opening corresponds to a recessed position on the back of the upper cutting mold.

In the above scheme, guide ribs for guiding the upper cutting mold holder receiving component to move up and down are installed in the passage on the upper part of the main body, and work in coordination with concave channels at the periphery of the upper cutting mold holder receiving component.

In the above scheme, the receiving part on the lower part of the main body to receive the lower cutting mold holder is provided with a receiving groove and a positioning groove which is intersected with the receiving groove, the lower cutting mold holder is movably inserted with regard to the receiving groove, while spliced by coordinating with a locking member with regard to the positioning groove, and the locking member is used for locking the lower cutting mold holder. The locking member is provided with a convex positioning column which is used for receiving positioning holes in a straight line positioning member and an angle positioning member, in order to realize rapid locking of the straight line positioning member and the angle positioning member.

In the above scheme, a large spring is arranged between the upper cover and the cover plate, the large spring is sleeved with the tubular part of the upper cutting mold holder receiving component, and a plurality of axial ribs are arranged at the periphery of the tubular part of the upper cutting mold holder receiving component.

The craft punch provided by the present invention is simple in structure, scientific and reasonable, could facilitate the replacement of a lower cutting mold and an upper cutting mold, has high flexibility, works more effectively and saves resources. It is convenient to operate and low in investment cost, greatly improves the operating ratio and operability of the craft punch, conforms to the industrial application, and improves the production efficiency.

Figure 1:
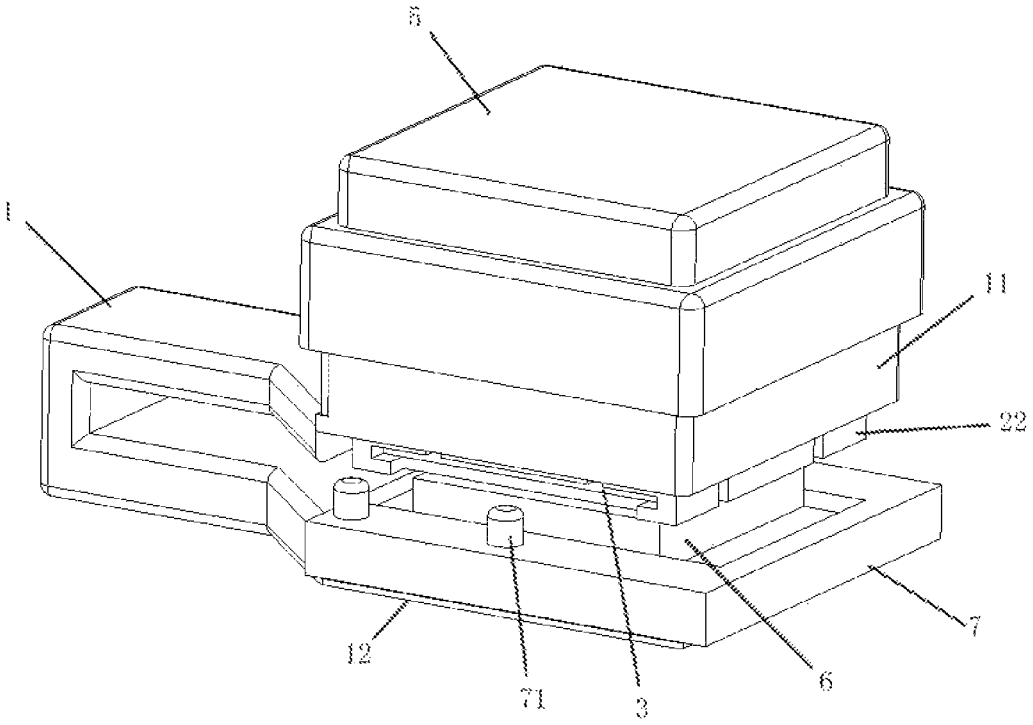
FIG. 1 is an appearance schematic diagram of one embodiment of the present invention.

DETAILED EMBODIMENT:

The present invention could be further illustrated via the following accompanying drawings:

FIGS. 1, 2, 3 and 4 are schematic diagrams of better embodiments of the present invention. The present invention relates to a craft punch with a replaceable cutting tool, comprising a main body 1, wherein the main body 1 has an upper part 11 and a lower part 12 which are spaced up and down, a gap 13 allowing paper to be inserted is formed between the upper part 11 and the lower part 12, the upper part 11 has a passage 111, and the lower part 12 has a receiving part 121 to movably receive a lower cutting mold holder 6; an upper cutting mold holder receiving component 2, which could be installed in the passage 111 on the upper part 11 of the main body movably up and down, wherein the upper side of the upper cutting mold holder receiving component 2 is provided with a tubular part 21, and the side opposite to the upper side of the upper cutter mold holder receiving component with the tubular part is provided with a receiving part 22 which movably receives an upper cutting mold 3; a cover plate 4, which covers the upper end of the passage 111 on the upper part 11 of the main body, and is provided with a through hole 41 allowing the tubular part 21 of the upper cutting mold holder receiving component to pass through, wherein the cover plate 4 is sleeved with a positioning pin 112 on the upper part 11 of the main body through a positioning hole 42 in its edge to be locked at the upper end of the passage 111; and an upper cover 5, which covers the upper side of the cover plate 4, and is connected with the tubular part 21 of the upper cutting mold holder receiving component.

Figure 2:
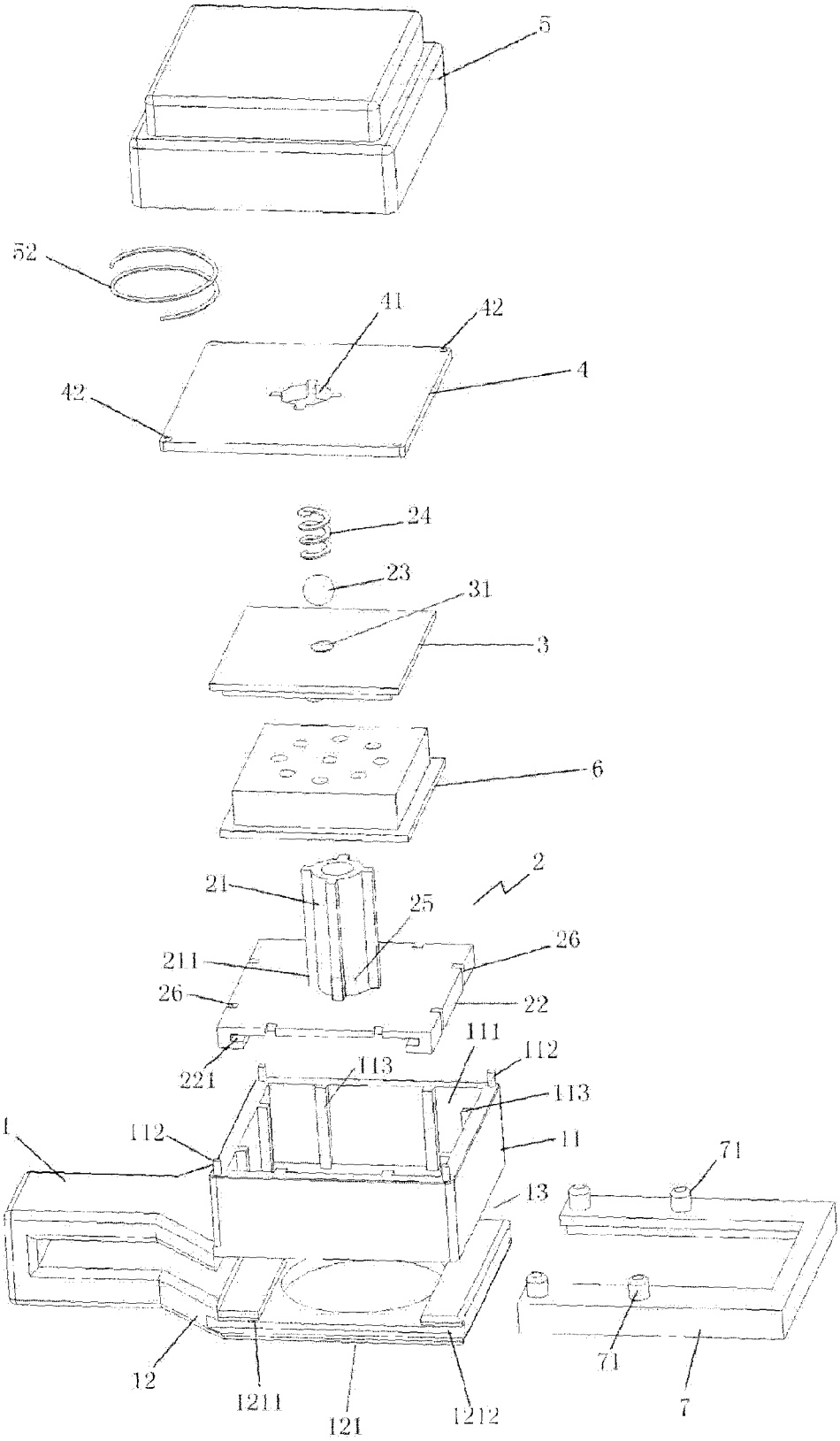
FIG. 2 is a structural decomposition schematic diagram of embodiment in FIG. 1.

As shown in FIG. 2, the receiving part 22 of the upper cutting mold holder receiving component is provided with a slot 221 allowing the upper cutting mold 3 to be movably, and a positioning structure for positioning of the upper cutting mold 3 which comprises a positioning ball 23 and a small spring 24, wherein the positioning ball 23 and the small spring 24 are sequentially installed in a hollow part of the tubular part 21 of the upper cutting mold holder receiving component, the upper cover 5 is provided with a convex column 51 which is inserted into an inlet of the tubular part 21 of the upper cutting mold holder receiving component to eject and press the small spring 24, the other end of the small spring 24 pushes and ejects the positioning ball 23 to enable the positioning ball 23 to be partially exposed out of an opening 25 in the receiving part of the upper cutting mold holder receiving component, and a part of the positioning ball 23 which is exposed out of the opening corresponds to a recessed position 31 on the back of the upper cutting mold 3. During operation, the upper cutting mold 3 could be easily inserted into the slot 221 of the receiving part 22 of the upper cutting mold holder receiving component, as the slot 221 is of straight-through form, allowing any one of peripheral positioning sides of the upper cutting mold 3 to be inserted into the slot 221, so that the cutting shape could be converted by four different angles, and the application of converting the design/shape by four directions and angles is impossible to be practiced in the production and mode of the traditional craft punch.

As shown in FIG. 2, guide ribs 113 for guiding the upper cutting mold holder receiving component 2 to move up and down are installed in the passage 111 on the upper part 11 of the main body, and work in coordination with concave channels 26 at the periphery of the upper cutting mold holder receiving component so as to ensure that the upper cutting mold holder receiving component 2 linearly moves up and down, and meet the needs of cutting operation, and the operation is stable.

As shown in FIG. 2, the receiving part 121 on the lower part 12 of the main body to receive the lower cutting mold holder is provided with a receiving groove 1211 and a positioning groove 1212 which is intersected with the receiving groove, the lower cutting mold holder 6 is movably inserted with regard to the receiving groove 1211, while spliced by coordinating with a locking member 7 with regard to the positioning groove 1212, and the locking member 7 is used for locking the lower cutting mold holder 6. The receiving groove 1211 is also of straight-through form, while the positioning groove 1212 is arranged at two ends of the receiving groove 1211 and is perpendicular to the receiving groove 1211. The locking member 7 is installed by inserting to well limit two movable ends of the lower cutting mold holder 6 so as to accurately lock the lower cutting mold holder 6, so that the installation is very convenient. This structure facilitates the insertion and replacement of the lower cutting mold holder 6, and could work by coordinating with changes of the above upper cutting mold 3 in four directions, so that the design cutting tool of the upper cutting mold 3 could cut into the lower cutting mold holder 6 to complete a cutting process.

Figure 4:
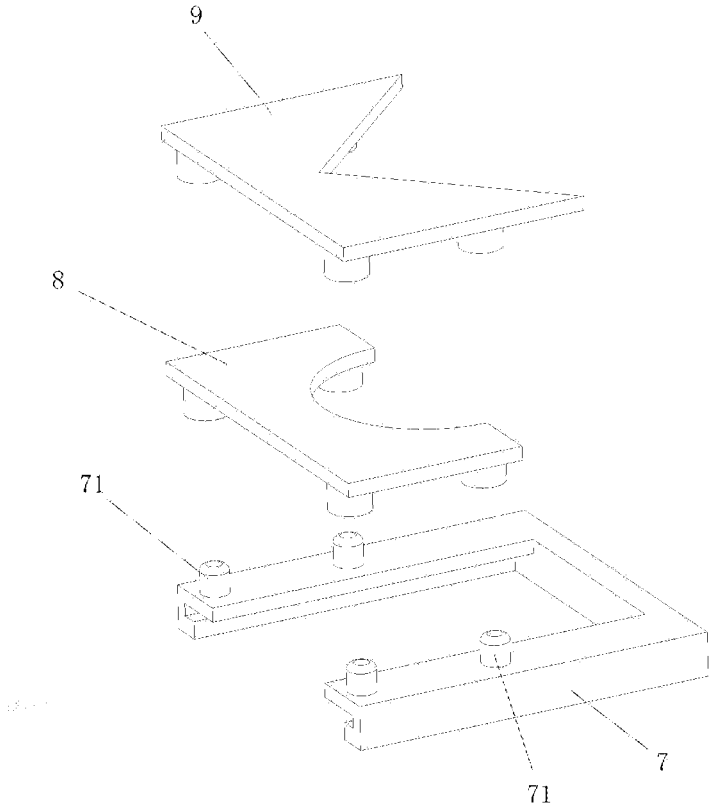
FIG. 4 is a positioning schematic diagram of a straight line positioning member and an angle positioning member in the implementation of the present invention.

As shown in FIG. 4, the locking member 7 is provided with a convex positioning column 71 which is used for receiving positioning holes in a straight line positioning member 8 and an angle positioning member 9, in order to realize rapid locking of the straight line positioning member 8 and the angle positioning member 9. The straight line positioning member 8 or the angle positioning member 9 is locked on the upper part of the locking member 7, so that after the locking member 7 is inserted into the lower part 12 of the main body, by coordinating with the straight line positioning member 8, the distance of paper could be fixed on the straight line positioning member 8 when the paper is inserted so as to ensure that cut designs could be arranged in a straight line on the paper, while the angle positioning member 9 could enable a right angle of the paper to be accurately positioned on the angle positioning member 9 so as to cut right-angle cutting designs/shapes with same distance; and it is simple in structure, scientific and reasonable, and easy and convenient to operate.

Figure 3:
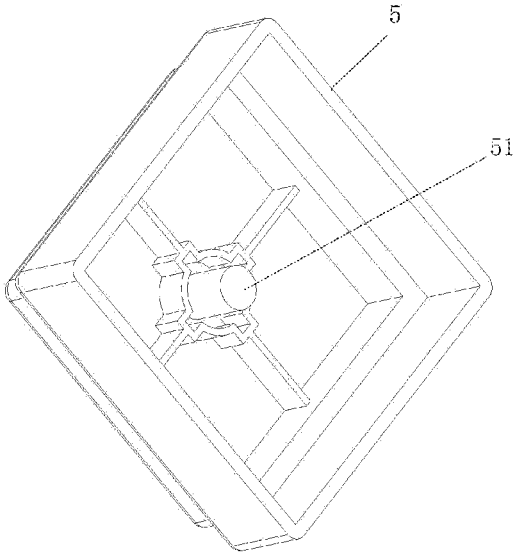
FIG. 3 is a schematic diagram of an upper cover of embodiment in FIG. 1.

As shown in FIGS. 2 and 3, a large spring 52 is arranged between the upper cover 5 and the cover plate 4, the large spring 52 is sleeved with the tubular part 21 of the upper cutting mold holder receiving component, and a plurality of axial ribs 211 are arranged at the periphery of the tubular part 21 of the upper cutting mold holder receiving component. The large spring 52 could be used for vertically hanging the upper cutting mold holder receiving component 2 on the upper part 11 of the main body, as well as pressing and resetting the upper cutting mold holder receiving component 2.

Of course, the above figures only show better embodiments of the present invention, without limitations on the implementation scope of the present invention; therefore, all equivalent changes or modifications made in accordance with the principle of the present invention shall be covered within the scope of protection of the present invention.

What is claimed is:

1. A craft punch with a replaceable cutting tool, comprising:

a main body, having an upper part and a lower part which are spaced up and down, wherein a gap allowing paper to be inserted is formed between the upper part and the lower part, the upper part has a passage, and the lower part has a receiving part to movably receive a lower cutting mold holder;

an upper cutting mold holder receiving component, which could be installed in the passage on the upper part of the main body movably up and down, wherein an upper side of the upper cutting mold holder receiving component is provided with a tubular part, and a side opposite to the upper side of the upper cutter mold holder receiving component with the tubular part is provided with a receiving part which movably receives an upper cutting mold;

a cover plate, which covers an upper end of the passage on the upper part of the main body, and is provided with a through hole allowing the tubular part of the upper cutting mold holder receiving component to pass through;

an upper cover, which covers an upper side of the cover plate, and is connected with the tubular part of the upper cutting mold holder receiving component;

wherein it is characterized in that: the receiving part of the upper cutting mold holder receiving component is provided with a slot allowing the upper cutting mold to be movably inserted, and a positioning structure for positioning of the upper cutting mold;

and the positioning structure for positioning of the upper cutting mold comprises a positioning ball and a small spring which are sequentially installed in a hollow part of the tubular part of the upper cutting mold holder receiving component, wherein the upper cover is provided with a convex column which is inserted into an inlet of the tubular part of the upper cutting mold holder receiving component to eject and press the small spring, an end of the small spring opposite to an end pressed by the convex column pushes and ejects the positioning ball to just enable the positioning ball to be partially exposed out of an opening in the receiving part of the upper cutting mold holder receiving component, and a part of the positioning ball which is exposed out of the opening is positioned corresponding to a recessed position on a surface of the upper cutting mold.

2. A craft punch with a replaceable cutting tool according to claim 1, characterized in that: the slot is of straight-through form, allowing at least one of a plurality of peripheral positioning sides of the upper cutting mold to be inserted into the slot.

3. A craft punch with a replaceable cutting tool according to claim 1, characterized in that: guide ribs for guiding the upper cutting mold holder receiving component to move up and down are installed in the passage on the upper part of the main body, and work in coordination with concave channels at a periphery of the upper cutting mold holder receiving component.

4. A craft punch with a replaceable cutting tool according to claim 1, characterized in that: the receiving part on the lower part of the main body to receive the lower cutting mold holder is provided with a receiving groove and a positioning groove which is intersected with the receiving groove, the lower cutting mold holder is movably inserted with regard to the receiving groove, while spliced by coordinating with a locking member with regard to the positioning groove, and the locking member is used for locking the lower cutting mold holder.

5. A craft punch with a replaceable cutting tool according to claim 4, characterized in that: the locking member is provided with a convex positioning column.

6. A craft punch with a replaceable cutting tool according to claim 1, characterized in that: a large spring is arranged between the upper cover and the cover plate, the large spring is sleeved with the tubular part of the upper cutting mold holder receiving component, and a plurality of axial ribs are arranged at a periphery of the tubular part of the upper cutting mold holder receiving component.

* * * * *